US005203555A

United States Patent [19]

Cannaverde et al.

[11] Patent Number: 5,203,555

[45] Date of Patent: Apr. 20, 1993

[54] ADJUSTABLE DAMPENING DEVICE IN AN APPARATUS FOR DETECTING DOUBLE FED SHEETS

[75] Inventors: Joseph A. Cannaverde, New Milford; Joseph H. Marzullo, Brookfield; Ming Xiao, Terryville, all of Conn.

[73] Assignee: Pitney Bowes Inc., Stamford, Conn.

[21] Appl. No.: 941,274

[22] Filed: Sep. 4, 1992

[51] Int. Cl.[5] ..... B65H 7/02

[52] U.S. Cl. ..... 271/263

[58] Field of Search ..... 271/262, 263

[56] References Cited

U.S. PATENT DOCUMENTS

| | | | |
|---|---|---|---|
| 2,767,839 | 10/1956 | Frommer | 209/74 |
| 4,378,109 | 3/1983 | Takahashi et al. | 271/263 |
| 4,420,747 | 12/1983 | Kistner | 340/674 |
| 4,426,785 | 1/1984 | Loftus et al. | 33/147 L |
| 4,527,793 | 7/1985 | Bottcher et al. | 271/263 |
| 4,550,252 | 10/1985 | Tee | 250/223 R |
| 4,614,867 | 9/1986 | Lane | 250/223 R |
| 4,664,369 | 5/1987 | Graef et al. | 271/263 |
| 4,700,368 | 10/1987 | Munn et al. | 377/8 |
| 4,777,729 | 10/1988 | Hausler | 271/263 X |
| 4,879,513 | 11/1989 | Spiegel et al. | 324/207 |
| 4,909,499 | 3/1990 | O'Brien et al. | 271/10 |
| 5,007,628 | 4/1991 | Skinner | 271/263 |

*Primary Examiner*—Richard A. Schacher
*Attorney, Agent, or Firm*—Charles R. Malandra, Jr.; Melvin J. Scolnick

[57] ABSTRACT

In a mechanism for detecting double sheets fed from a feeder, including an actuator arm operatively coupled at one end to a magnet and at the other end to a paper follower, wherein the paper follower follows the profile of each sheet or group of sheets being conveyed between the paper follower and a fixed transport deck below thereto, the paper follower causing the actuator arm to pivot about a first axis to raise and lower the magnet with respect to a stationary electromagnetic sensor, an improvement comprises a flat spring mounted at one end to a shaft extending along the first axis, and a lever, having a pin for supporting an other end of the flat spring. The lever is pivotally mounted along a second axis for pivoting the pin between at least a first and second position wherein the flat spring provides a first dampening load to the paper follower and the actuator arm when the lever is in the fist position and provides a second dampening load to the actuator arm when the lever is in the second position.

4 Claims, 4 Drawing Sheets

ADJUSTABLE DAMPENING DEVICE IN AN APPARATUS FOR DETECTING DOUBLE FED SHEETS

BACKGROUND OF THE INVENTION

The subject invention relates to feeding of single sheets of paper or the like from a stack of sheets for processing by folders, printers, copiers or the like. More particularly, it relates to detecting double fed sheets which occur when a sheet feeder fails to properly singulate sheets from the stack.

In printers, copiers, inserters, and similar such systems it is frequently necessary to singulate sheets from a stack of sheets for further processing by the system. In inserters, the singulation of envelopes is also known. Sheet feeding or envelope feeding apparatus for performing this singulation function are well known, and, in general, they are effective. However, inevitably such sheet feeders will fail to singulate and will feed a "double" sheet (i.e., two or more overlapping sheets). Such double fed sheets may result in sheets being grouped incorrectly for further processing. The double fed sheets may also jam in the system, requiring operator intervention to clear the jam. Perhaps more importantly, if the sheets contain information or are otherwise unique (e.g., return of cancelled checks) then their destruction in a jam caused by a double feed may significantly interfere with operations.

For these reasons it is known to provide such systems with detectors downstream from the sheet feeder to detect double fed sheets before a jam and possible destruction of the sheets can occur. One known method is to use an optical system to measure the transparency of a sheet after it is fed from the sheet feeder. Another known method uses precise, sensitive mechanical switches to detect an increase in the thickness of a fed sheet. Both of these methods for detecting double fed sheets involve precise, painstaking adjustments each time the type of sheet to be fed is changed.

Another known method uses a roller/arm assembly coupled to a distance measuring device such as a hall sensor. A primary object for such methods and apparatus of detection is to accurately and reliably detect "double" feeds without causing damage to the sheets being fed. Achieving this object is a problem when the feeder must handle sheet material of varying thicknesses. If a double detect apparatus is configured to detect thick sheets or envelopes, there is a likelihood that if thin sheets or envelopes are fed, detection of double feed will not occur. Conversely, if the apparatus were set to detect thin sheets or envelopes, then feeding thick sheets or envelopes may cause jamming or stalling of the feeding process.

Heretofore, any adjustment to the double detect apparatus, for example to handle sheets of varying thickness, has generally been performed by a service technician. Since sheet feeders can be operator adjusted to handle sheets of varying thicknesses, the double detect mechanism is a hindrance to an operator making such a change without a service call.

U.S. Pat. Nos. 4,879,513 and 4,378,109 disclose devices for measuring the thickness of paper on surface. However, the devices do not include adjustments means for handling thick or thin material.

SUMMARY OF THE INVENTION

It has been found that the load on a paper follower of a double detect mechanism can be easily adjusted to be compatible with the thickness of the sheets being detected.

In a mechanism for detecting double sheets fed from a feeder, including an actuator arm operatively coupled at one end to a magnet and at the other end to a paper follower, wherein the paper follower follows the profile of each sheet or group of sheets being conveyed between the paper follower and a fixed transport deck below thereto, and wherein the paper follower causes the actuator arm to pivot about a first axis to raise and lower the magnet with respect to a stationary electromagnetic sensor, an improvement comprises a flat spring mounted at one end to a shaft extending along the first axis, and a lever, having a pin for supporting an other end of the flat spring. The lever is pivotally mounted along a second axis for pivoting the pin between at least a first and second position wherein the flat spring provides a first dampening load to the paper follower and the actuator arm when the lever is in the first position and provides a second dampening load to the actuator arm when the lever is in the second position.

BRIEF DESCRIPTION OF THE PREFERRED EMBODIMENTS

Figure 1:
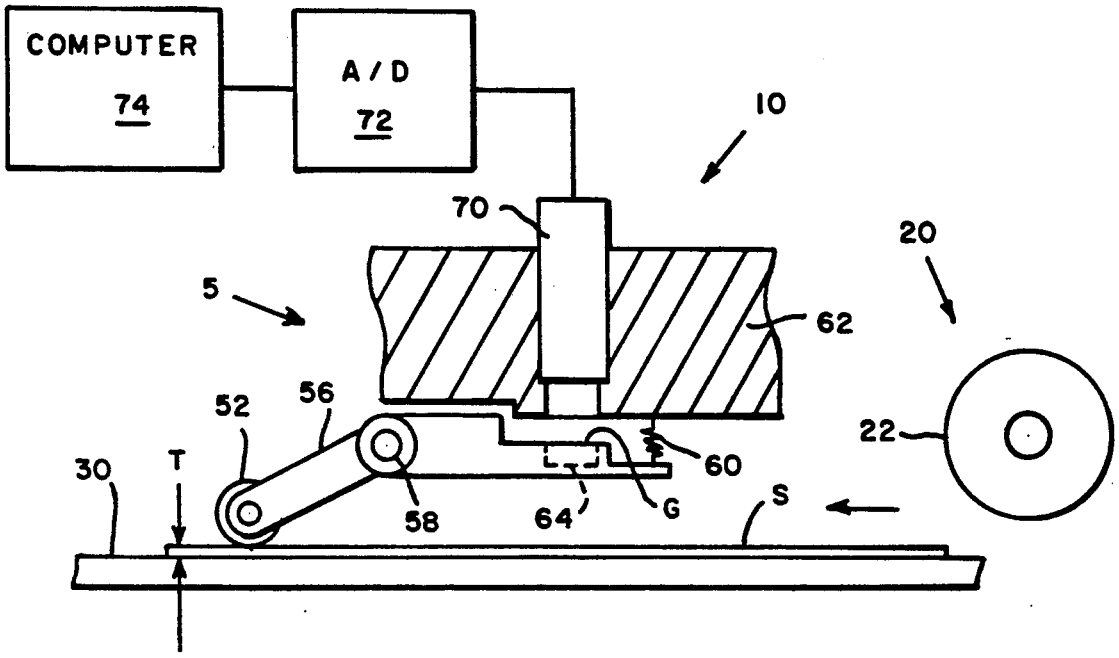
FIG. 1 shows a semi-schematic representation of a prior art mechanism for detecting double fed sheets in a paper handling system.

FIG. 1 shows a semi-schematic representation of a prior art double detection apparatus 5 in a paper handling system 10. System 10 includes a sheet feeder 20 which has a singulating roller 22 for separating single sheets from a stack of sheets (not shown) and feeding these sheets along a feed path 30 for further processing. Double detection apparatus 5 is provided downstream from sheet feeder 20 to detect double fed sheets. A photo detector (not shown) may be provided to detect leading and trailing edges of the sheets, or apparatus 5 may detect the leading and trailing edges of the sheet. An example of a sheet feeder in an inserting machine is disclosed in U.S. Pat. No. 5,104,112 issued on Apr. 14, 1992.

Sheet S is fed along feed path 30 by sheet feeder 20 and passes beneath follower roller 52. Roller 52 is mounted on lever arm 56 which rotates about pivot 58. Spring 60 is mounted in tension between lever arm 56 and frame 62 to provide a restoring force to maintain roller 52 in positive engagement with sheet S. As sheet S passes beneath roller 52 gap G will change by an amount proportional to thickness T of sheet S at the position beneath roller 52. It will be understood by those skilled in the art that the amount of restoring force or load resulting from spring 60 must be adequate to maintain such positive engagement. It has been found that the amount of load required to maintain positive engagement varies with the thickness of the material being detected.

A permanent magnet 64 is fixed to lever 56 in proximity to hall effect detector 70 which is fixed within frame 62. Thus, detector 70 produces an analog output proportional to thickness T of sheet S at the position beneath roller 52. The analog output is sampled by A/D convertor 72 to generate digital inputs signals which are input to computer 74. The input signals are processed by computer 74 to generate a double detect signal if a double fed sheet passes beneath roller 52.

In accordance with the present invention, an adjustable spring load is provided whereby an operator can match the load from the spring to the thickness of the material being detected. Reference is made to U.S. Pat. application Ser. No. 970,671 field on Oct. 8, 1992, entitled METHOD AND APPARATUS FOR DETECTING DOUBLE FED SHEETS which discloses the processing signals from the double detection apparatus to determine average sheet thickness or length for comparison to predetermined reference values.

Figure 2:
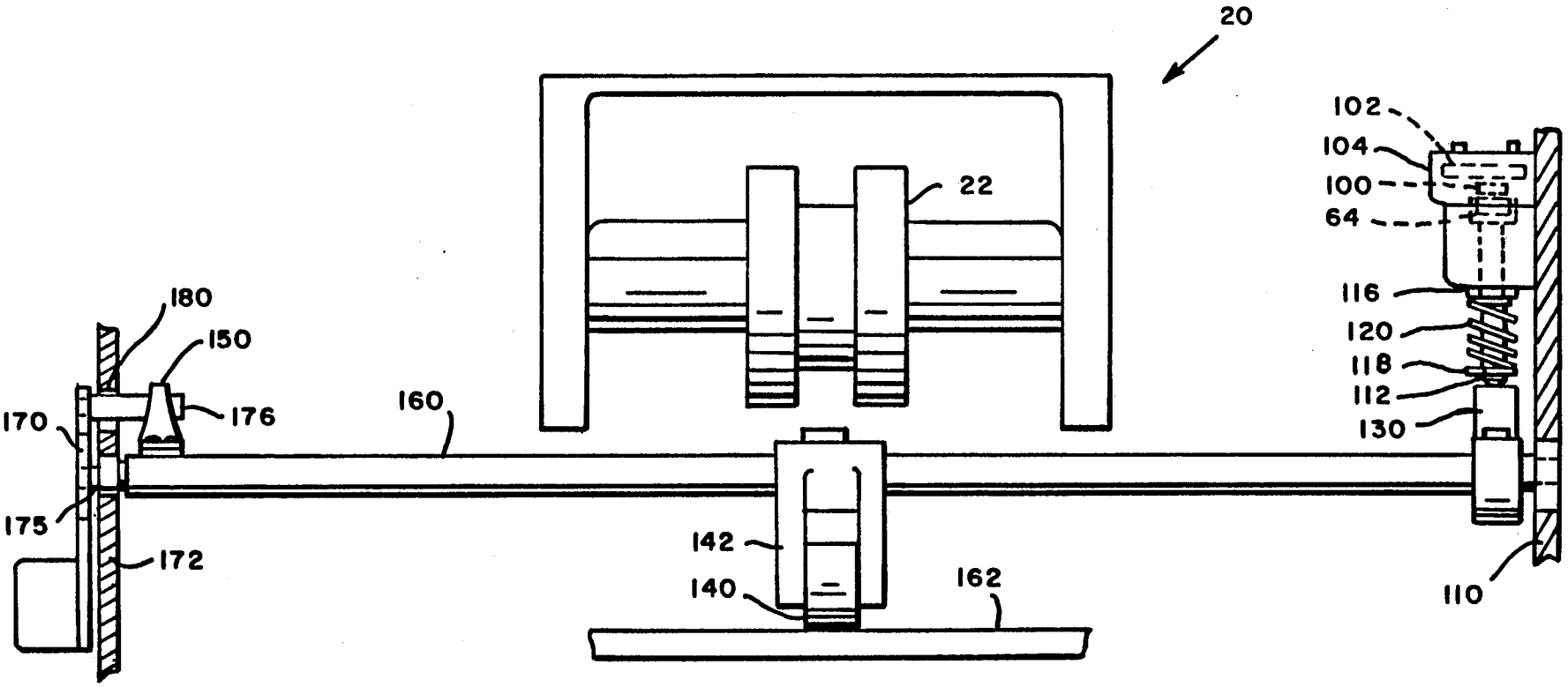
FIG. 2 shows a front view of a double detecting apparatus in accordance with the present invention.
Figure 3:
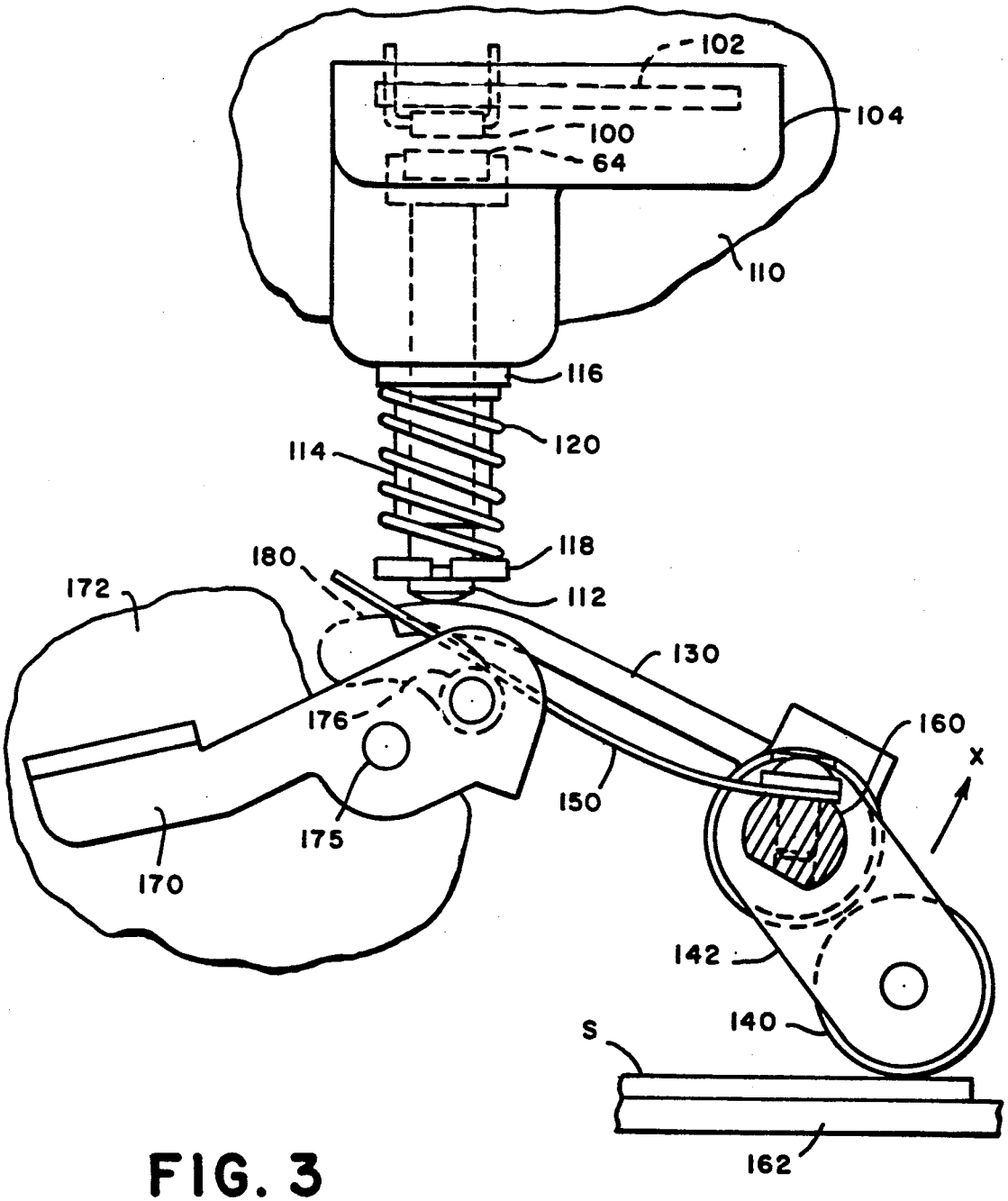
FIG. 3 shows a side elevational view of the double detecting apparatus of FIG. 2 adjusted for detecting double feeds of thick material.
Figure 4:
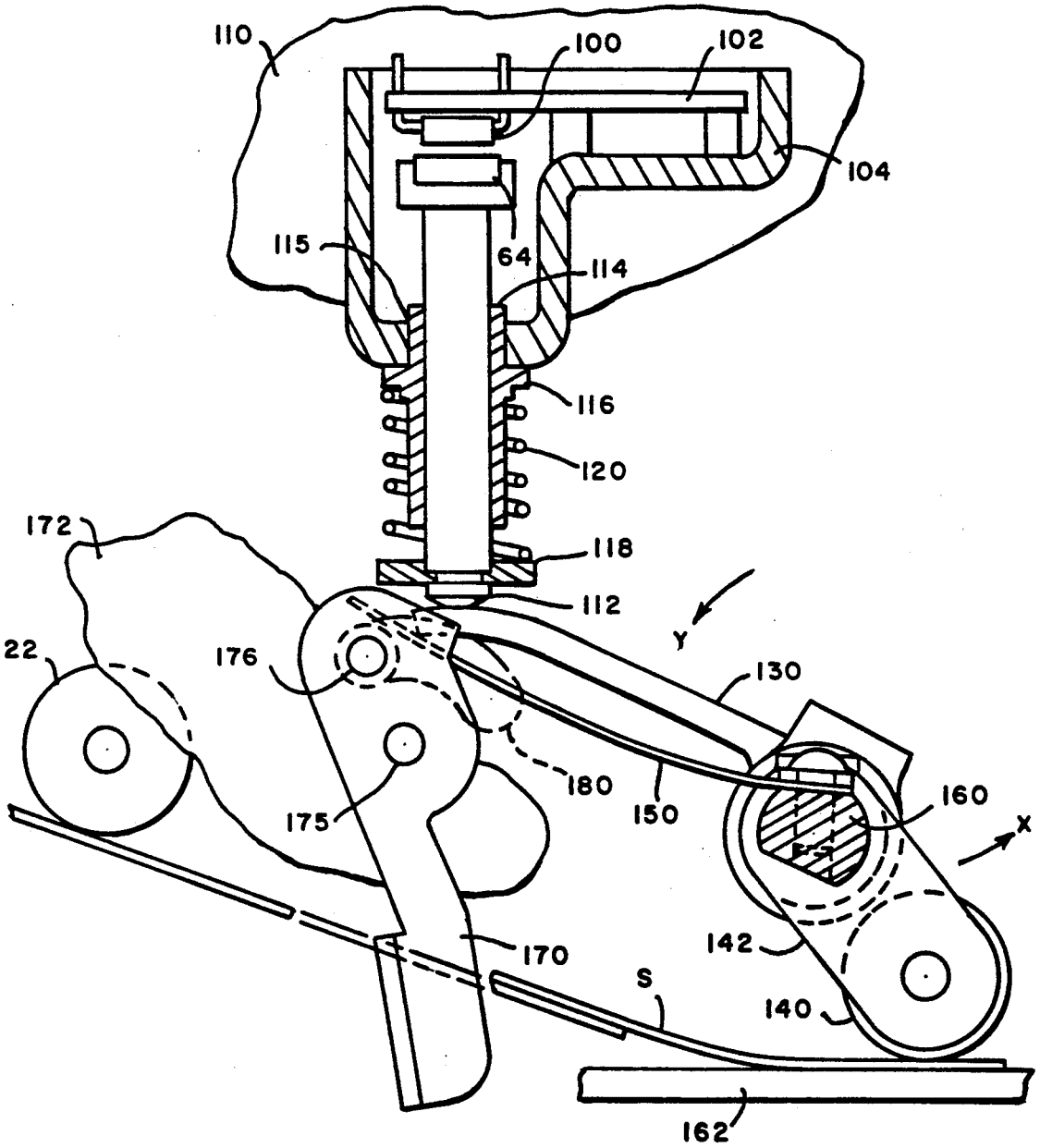
FIG. 4 shows a side elevational view of the double detecting apparatus of FIG. 2 adjusted for detecting double feeds of thin material.

Referring to FIGS. 2–4, there is shown double detect system with an adjustable dampening device in accordance with the present invention. The double detect system utilizes a hall effect sensor 100 which is mounted in a sensor board 102. Sensor board 102 is mounted in a sensor housing 104 which is attached to frame member 110. Detector 70 may be a model 92SS12-2 analog positions sensor marketed by the MicroSwitch division of Honeywell Corporation, or equivalent. However, other forms of sensors, such as inductive sensors, strain gauges, etc. are within the contemplation of the subject invention.

Actuator follower 112 is mounted through a sleeve bearing 114, e.g., a bronze bearing, which fits through an aperture 115 in sensor housing 104. Bearing 114 has a lip 116 which operates as a stop against aperture 115. The lower section of actuator follower 112 includes a slotted portion which accepts an e-clip 118. Helical spring 120 extends between lip 116 of bearing 114 and e-clip 118 to provide a load towards actuator arm 130.

Thus, actuator follower 112 is spring loaded to maintain contact with an actuator arm 130. Actuator follower 112 contains a magnet 64 which is mounted to the top of actuator follower 112 below sensor 100. As actuator arm 130 moves up and down, actuator follower 112 and magnet 64 do likewise. This changes the magnetic force on the hall effect sensor 100, which in turn causes a voltage change in a proportion to the paper thickness. In the preferred embodiment, the magnet is an SmCo rare earth magnet.

A paper follower 140, a flat spring 150 and actuator arm 130 are all attached to a "D"-shaft 160. The D-shaft is supported by two ball bearing assemblies 163, one at each end of shaft 160, which allows free rotation of the shaft. In FIG. 2, the preferred locations of paper follower 140, spring 150 and actuator arm 130 are shown. Paper follower 140 is located at the center of shaft 160 downstream of feed rollers 22. Spring 150 is located at one side wall for operator adjustment. Actuator arm 130 is located at the other side wall for convenience in mounting sensor housing 104.

As paper passes between paper follower 140 and transport deck 162 below, paper follower 140 rotates about shaft 160 in counterclockwise direction (arrow X) causing actuator arm 130 to rotate about shaft 160 in a counterclockwise direction (arrow Y), simultaneously causing deflection of flat spring 150.

In accordance with the present invention, a lever 170 is pivotally mounted to a frame member 172 at 175 in a suitable manner. Lever 170 includes a pin 176 which extends through a cam-shaped slot 180 in frame member 172. Pin 176 supports the end of flat spring 150 which is not mounted to shaft 160. Lever 170 pivots at 175, changing the moment in flat spring 150. The force from pin 176 deflects flat spring 150 causing a moment about shaft 160 in a clockwise direction. This dampens the response of paper follower 140 and thus actuator arm 130, and prevents actuator follower 112 from actuating multiple times on a single pass of a sheet.

The pivoting of lever 170 allows two distinct spring rates to be chosen. The position shown in FIG. 4 allows thinner, lighter material to pass between paper follower 140 and the fixed surface deck 162 below without stalling and still allow hall effect sensor 100 to activate without multiple actuations.

The position shown in FIG. 3 allows greater dampening to the response of the actuator arm 130 when thicker, heavier material passes between paper follower 140 and deck 162 below. The end result being that the higher dampening effect prevents the follower 140 from actuating multiple times on a single pass due to the higher impact force of the thicker, heavier material.

Figure 5:
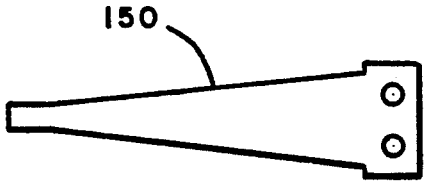
FIG. 5 shows a top view of the preferred shape of the flat spring used in the adjustment device of the present invention.

In the preferred embodiment of the present invention, flat spring 150 is made of copper-beryllium alloy, having the shape shown in FIG. 5. Spring 150 has a thickness of 0.008 inches.

With the lever in the position shown in FIG. 4, spring 150 provides a pre-load, i.e., without a sheet under paper follower 140, of 4.1 ounces. When the lever is moved to the position shown in FIG. 3, spring 150 provides a pre-load of 8.3 ounces. The final load, i.e., when sheet thickness is being detected, varies depending on the position of the lever and the thickness of the sheet being detected. In Table I, examples of final load are provided.

TABLE I

| Paper Thickness | Pin in Position 1 | Pin in Position 2 |
|---|---|---|
| .003" | 4.3 oz | 8.6 oz |
| .007" | 4.6 oz | 9.0 oz |
| .050" | 7.6 oz | 13.0 oz |
| .1" | 10.5 oz | 17.0 oz |

It has been found that the selection between Position 1 and Position 2 depends not only on the thickness of the paper being detected but the type of material being detected. Thus, a threshold thickness cannot be identified as the only basis for selecting the position of lever 170. It has been determined that for at least a thickness up to 0.1 inch at least one of the two positions is suitable regardless of the type of the paper being detected.

The above description describes the preferred embodiment of the invention and should not be viewed as limiting. The scope of the invention is set forth in the appendix claims.

What is claimed is:

1. In a mechanism for detecting double sheets fed from a feeder, including an actuator arm operatively coupled at one end to a magnet and at the other end to a paper follower, wherein said paper follower follows the profile of each sheet or group of sheets being conveyed between said paper follower and a fixed transport deck below thereto, said paper follower causing said actuator arm to pivot about a first axis to raise and lower the magnet with respect to a stationary electromagnetic sensor, an improvement comprising:

a flat spring mounted at one end to a shaft extending along the first axis;

a lever, having a pin for supporting an other end of said flat spring, said lever being pivotally mounted along a second axis for pivoting said pin between at least a first and second position wherein said flat spring provides a first dampening load to the paper follower and the actuator arm when said lever is in said first position and provides a second dampening load to said actuator arm when said lever is in said second position.

2. The improvement of claim 1 wherein said pin moves within a cam surface, as said lever pivots between said first and second positions, said spring applying sufficient force against said pin to maintain said pin in a desired one of said first and second positions.

3. The improvement of claim 2 wherein said paper follower is an idler roller resting against said transport deck, said idler roller rigidly mounted to a shaft to which said actuator arm is mounted, said flat spring being rigidly mounted to said shaft.

4. The improvement of claim 3 wherein said cam surface is a slot in a side frame member through which said pin extends, said lever being pivotally mounted to the outside of said frame member, said spring being located adjacent the inside of said frame member.

* * * * *